US005893764A

United States Patent [19]

Long

[11] Patent Number: 5,893,764

[45] Date of Patent: Apr. 13, 1999

[54] BOARD STRADDLE MOUNTED ELECTRICAL CONNECTOR

[75] Inventor: Jerry A. Long, Elgin, Ill.

[73] Assignee: Molex Incorporated, Lisle, Ill.

[21] Appl. No.: 08/787,723

[22] Filed: Jan. 24, 1997

[51] Int. Cl.[6] ..... H01R 23/70

[52] U.S. Cl. ..... 439/79; 439/570

[58] Field of Search ..... 439/79, 80, 59, 439/62, 327, 570, 856, 857, 64, 55

[56] References Cited

U.S. PATENT DOCUMENTS

| | | | |
|---|---|---|---|
| 4,572,604 | 2/1986 | Ammon et al. | 339/176 MP |
| 4,629,278 | 12/1986 | Norton et al. | 439/55 |
| 4,734,042 | 3/1988 | Martens et al. | 439/62 |
| 5,088,009 | 2/1992 | Harada et al. | 439/79 |
| 5,383,095 | 1/1995 | Korsunsky et al. | 439/59 |
| 5,704,807 | 1/1998 | Sherman et al. | 439/570 |

FOREIGN PATENT DOCUMENTS

| | | | |
|---|---|---|---|
| 5-315032 | 11/1993 | Japan | H01R 23/68 |

*Primary Examiner*—Paula Bradley
*Assistant Examiner*—Tho Dac Ta
*Attorney, Agent, or Firm*—A. A. Tirva

[57] ABSTRACT

A system is provided for straddle mounting an electrical connector having an elongated housing with opposite ends to a printed circuit board. A generally U-shaped mounting clip is provided having a pair of legs joined by a bight portion, the mounting clip having teeth thereon for relatively fixing the mounting clip to the housing. The legs are juxtaposed against the opposite surfaces of the printed circuit board for connection to appropriate mounting pads thereon, and the bight portion embraces a portion of the housing. The printed circuit board has an edge and opposite surfaces, with circuit traces on the opposite surfaces of the board near the edge. The electrical connector is adapted for straddle mounting to the printed circuit board at the edge thereof, with terminals on the housing and including tail portions for connection to the circuit traces on the opposite surfaces of the printed circuit board.

15 Claims, 3 Drawing Sheets

BOARD STRADDLE MOUNTED ELECTRICAL CONNECTOR

FIELD OF THE INVENTION

This invention generally relates to the art of electrical connectors and, particularly, to a system for straddle mounting an electrical connector to an edge of a printed circuit board.

BACKGROUND OF THE INVENTION

In the electronics industry, electrical connectors often are mounted to printed circuit boards for electrical connection to circuit traces on the boards. Typically, the electrical connectors are positioned on the printed circuit boards, and electrical terminals are soldered to circuits on the boards. The connectors usually include some form of locking or retention means to hold the connectors to the boards. The locking or retention means can vary from mounting posts molded integrally with the connector housings to separate mounting clips which engage the connector housings to hold the connectors to the board. The integral mounting posts or the separate clips usually are inserted into holes in the printed circuit board.

Providing locking or retention means as described above becomes more difficult when electrical connectors are mounted at the edge of a printed circuit board, such as in a cutout in the edge of the board. The locking or retention means becomes still more difficult to design when the electrical connectors are straddle mounted to the edge of the board. In other words, the connector may include terminals which are solder connected to both opposite sides or surfaces of the board.

Electrical connectors which are straddle mounted to the edge of a printed circuit board, as described above, often are more prone to become damaged during handling than connectors which are mounted on a surface of the board inwardly of the peripheral edges thereof. Without a secure locking or retention means, the housings of straddle mounted electrical connectors literally can be torn away from the retention clips and the connector terminals secured to opposite sides of the board.

The present invention is directed to solving these problems by providing a new and improved locking or retention means or system to hold straddle mounted connectors to the edge of a printed circuit board.

SUMMARY OF THE INVENTION

An object, therefore, of the invention is to provide a new and improved system for straddle mounting an electrical connector to a printed circuit board.

In the exemplary embodiment of the invention, the printed circuit board has an edge and opposite surfaces, with circuit traces on the opposite surfaces near the edge. The electrical connector includes an elongated housing having opposite ends, with the housing being adapted for straddle mounting to the printed circuit board along the edge thereof. Terminals are mounted on the housing and include tail portions for connection to the circuit traces on the opposite surfaces of the printed circuit board.

The invention contemplates a pair of generally U-shaped mounting clips each having a pair of legs joined by a bight portion. One mounting clip is located at each opposite end of the elongated housing. The bight portion of each mounting clip embraces a portion of the housing. The legs of each mounting clip are juxtaposed against the opposite surfaces of the printed circuit board for connection to appropriate mounting pads thereon.

As disclosed herein, the mounting clips are located in wing portions of the housing projecting longitudinally outwardly of the housing beyond a central mating portion of the housing. The housing has a mating side remote from the board and mounting side adjacent the edge of the board. A pair of passages extend through each wing of the housing between the mating side and the mounting side. The legs of a respective one of the mounting clips extend through the passages, and the bight portion of the mounting clip engages a portion of the housing at the mating side thereof. Therefore, the housing cannot be torn away from the mounting clips.

Other features of the invention include a pair of latches on the housing located longitudinally outwardly of the mounting clips. The latches are adapted for latching the connector to an appropriate complementary mating connector. The printed circuit board includes a cutout in the edge thereof for locating the housing of the connector.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
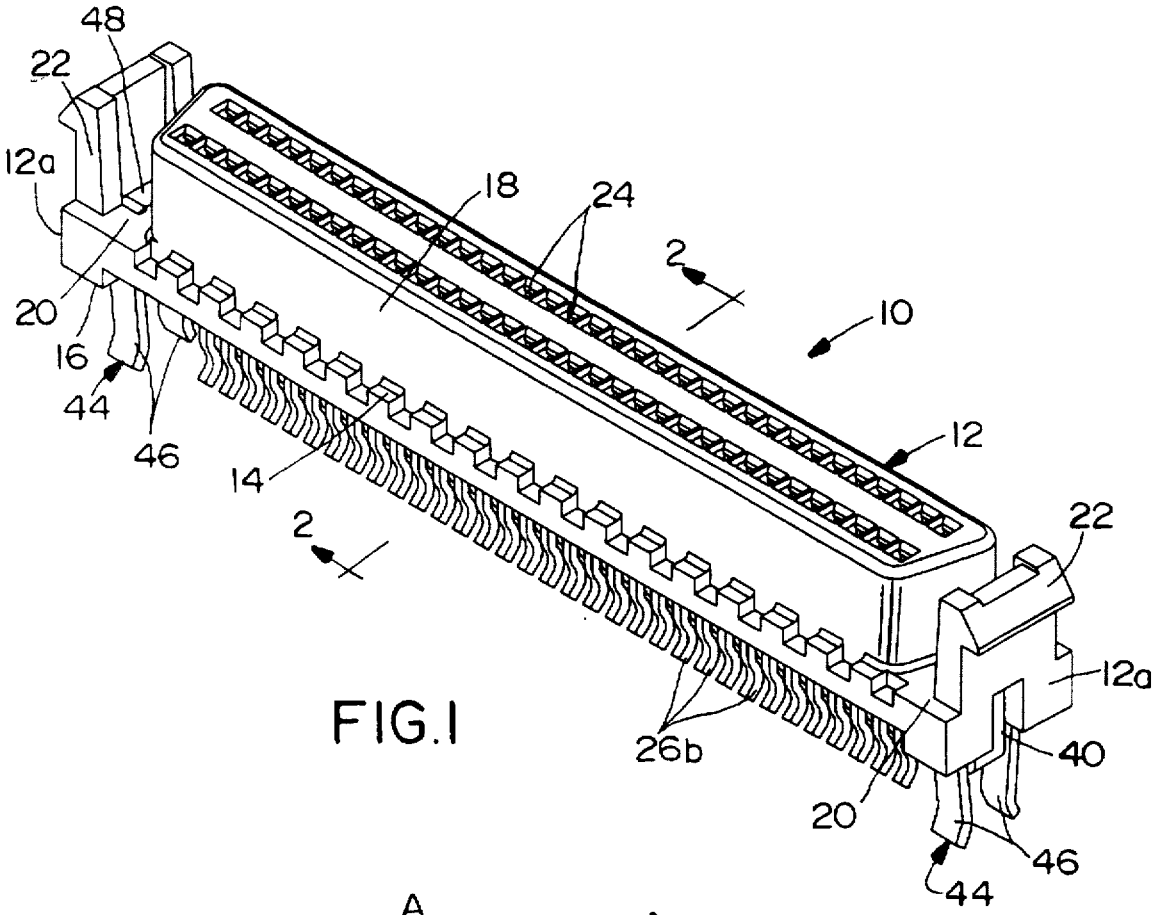
FIG. 1 is a perspective view of one embodiment of an electrical connector incorporating the concepts of the invention.
Figure 2:
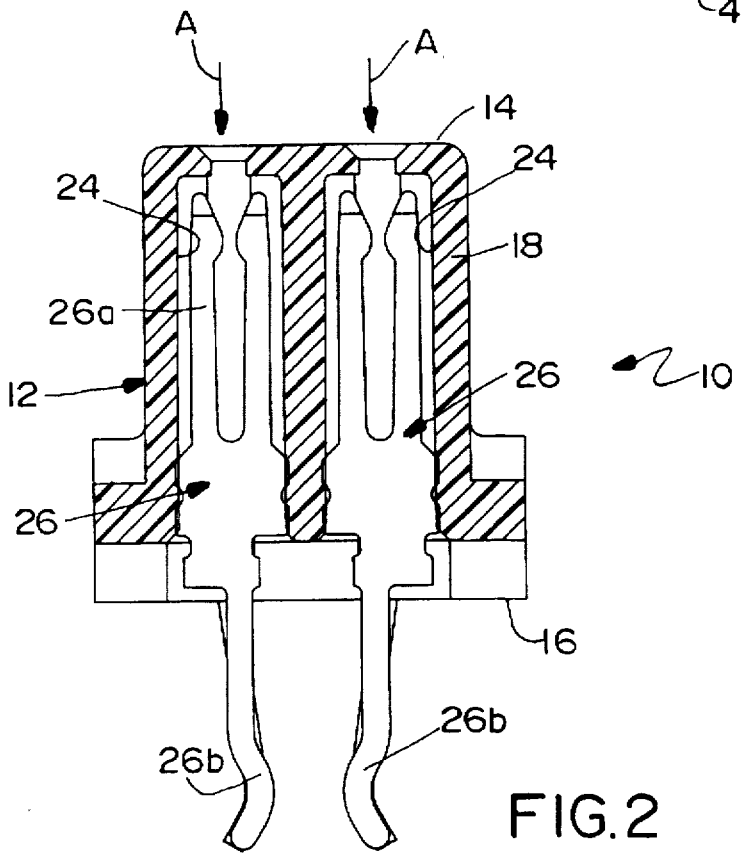
FIG. 2 is a vertical section taken generally along line 2—2 of FIG. 1.
Figure 3:
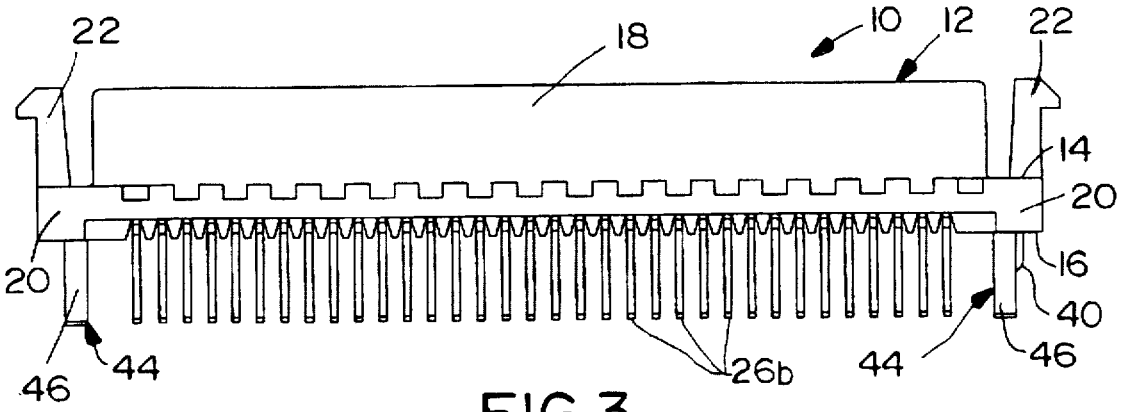
FIG. 3 is a side elevational view of the connector of FIG. 1.

Referring to the drawings in greater detail, and first to FIGS. 1–3, an electrical connector, generally designated 10, includes an elongated housing, generally designated 12, having opposite ends 12*a*. The housing has a mating side 14 and a mounting side 16, with a mating portion 18 projecting at the mating side. The housing includes a pair of wing portions 20 projecting longitudinally outwardly beyond mating portion 18. A pair of latch arms 22 project in a mating direction from wing portions 20 alongside but spaced longitudinally outwardly of the opposite ends of mating portion 14. Housing 12, including mating portion 18, wing portions 20 and latch arms 22, is a unitary structure molded of dielectric material such as plastic or the like.

As best seen in FIGS. 1 and 2, housing 12 of connector 10 includes a plurality of terminal-receiving passages 24 extending between mating side 14 and mounting side 16 of the housing through mating portion 18. The passages are arranged in two rows as best seen in FIG. 1 for mounting two rows of conductive terminals, generally designated 26, as best seen in FIG. 2. Each terminal includes a bifurcated or female end **26*a* for receiving a pin or male terminal of an appropriate complementary mating connector, with the pin terminals being inserted into passages 24 in the direction of arrows "A" (FIG. 2). The terminals have tail portions 26*b* projecting outwardly of passages 24 beyond mounting side 16** of the housing. The tail portions are arranged in two rows so that they are capable of connection to circuit traces on the opposite surfaces of a printed circuit board, as the connector is straddle mounted to an edge of the board.

Figure 4:
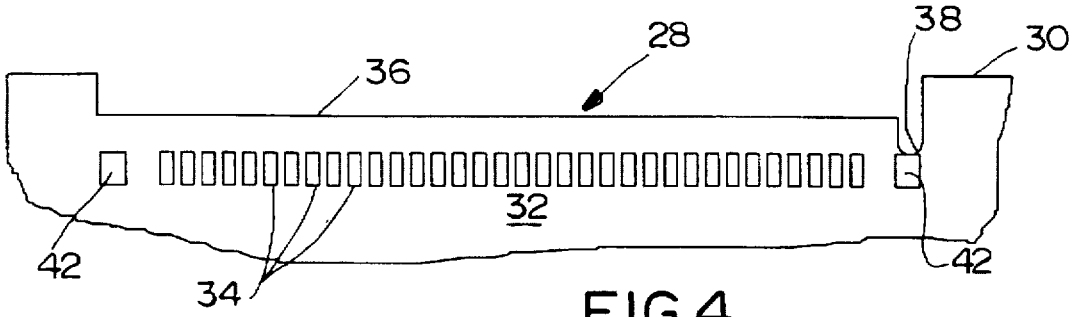
FIG. 4 is a fragmented plan view of an edge area of a printed circuit board whereat the connector is straddle mounted.

FIG. 4 shows a printed circuit board, generally designated 28, which has an edge 30 and opposite surfaces 32 with circuit traces which include contact pads 34 on both opposite surfaces of the board. The contact pads are arranged in a row on each opposite surface of the board for engaging the two rows of tail portions **26*b* (FIG. 2) of the terminals when the connector is straddle mounted to the edge of the board. Actually, the connector is mounted in a cutout 36 in edge 30 of the board, and the cutout has a polarizing notch 38 at one end thereof for receiving a polarizing boss 40 (FIGS. 1 and 3) projecting from mounting side 16 of the connector housing. Lastly, as seen in FIG. 4, a mounting pad 42 is located at each opposite end of each row of contact pads 34 on each opposite surface 32 of printed circuit board 12. Like contact pads 34 which are soldered to terminal tails 26*b*, mounting pads 42** are of solderable material.

The invention contemplates the provision of a pair of generally U-shaped mounting clips, generally designated 44, with each clip having a pair of legs 46 joined by a bight portion 48. One mounting clip 44 is located at each opposite end of elongated housing 12 in each wing portion 20 of the housing.

Figure 5:
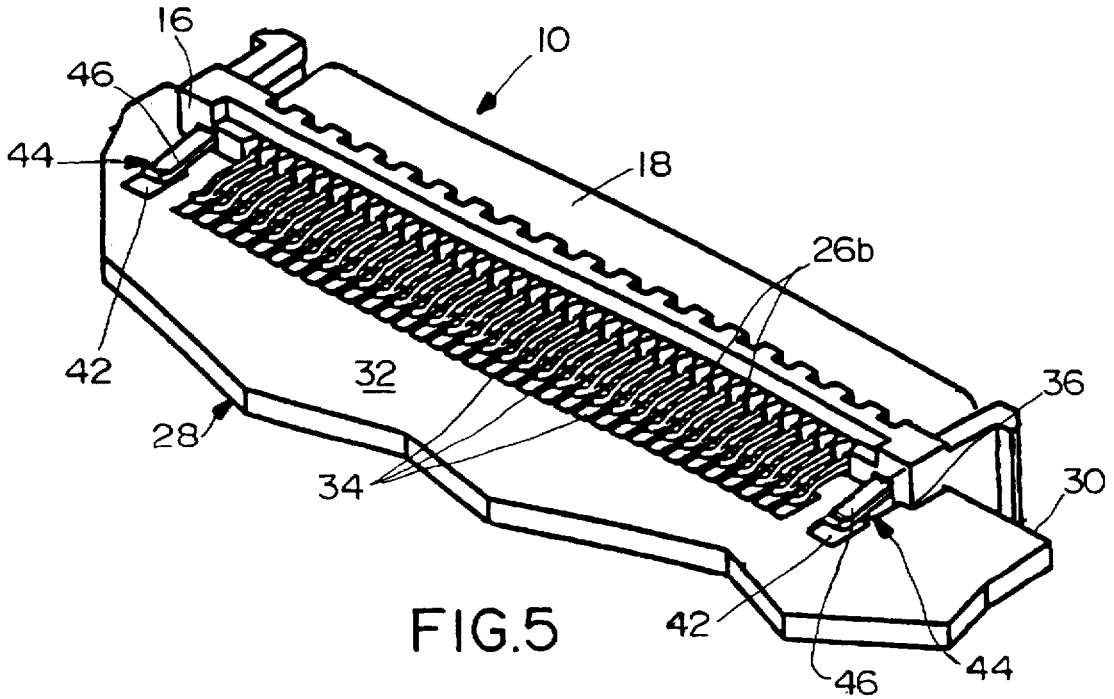
FIG. 5 is a rear perspective view showing the connector of FIG. 1 straddle mounted to the board of FIG. 4.

FIG. 5 shows electrical connector 10 straddle mounted within cutout 36 in edge 30 of printed circuit board 28. It can be seen that terminal tail portions **26*b* are in engagement with contact pads 34 on surface 32 of the printed circuit board. Although only one surface is visible in FIG. 5, the terminal tail portions from the connector are in engagement with the contact pads on the opposite or undersurface of the board as viewed in FIG. 5. It also can be seen how legs 46 of mounting clips 44 are in engagement with mounting pads 42 on the board. In final assembly, terminal tail portions 26*b* are soldered to contact pads 34 on the board, and legs 46 of mounting clips 44 are soldered to mounting pads 42** on the board.

Figure 6:
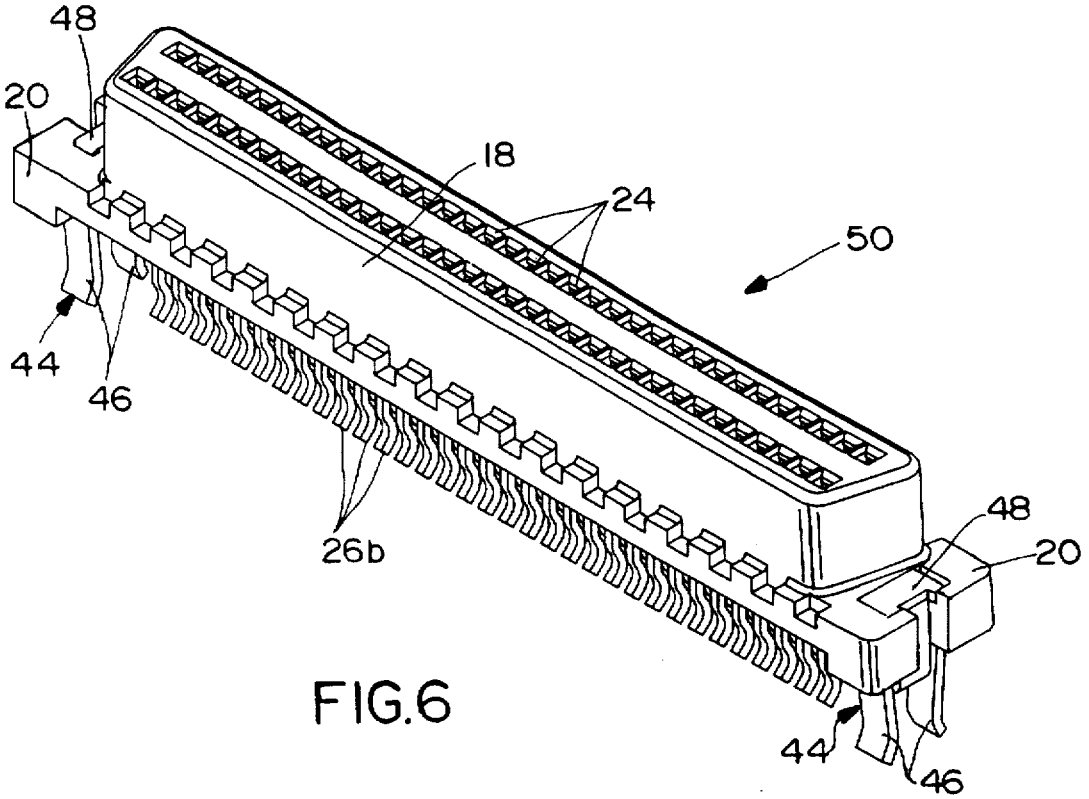
FIG. 6 is a perspective view of a second embodiment of an electrical connector incorporating the concepts of the invention.

FIG. 6 shows a modified version of the electrical connector and is generally designated 50. Connector 50 is substantially identical to connector 10 except that latch arms 22 of connector 10 are not used on connector 50. Therefore, like reference numerals have been applied to FIGS. 6–8 to designate like components of the connector as described above in relation to FIGS. 1–3 and 5. On the other hand, with the latch arms omitted from connector 50, the location and mounting of mounting clips 44 on the connector housing can be better seen in the embodiment of FIGS. 6–8.

Figure 8:
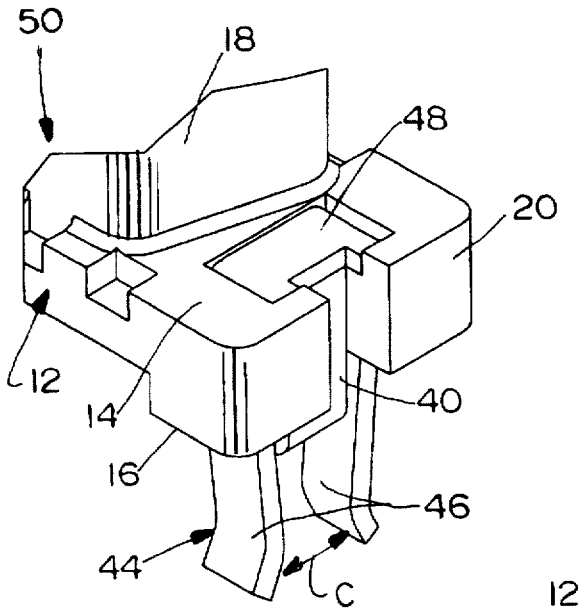
FIG. 8 is a view similar to that of FIG. 7, with the mounting clip inserted through the connector.
Figure 7:
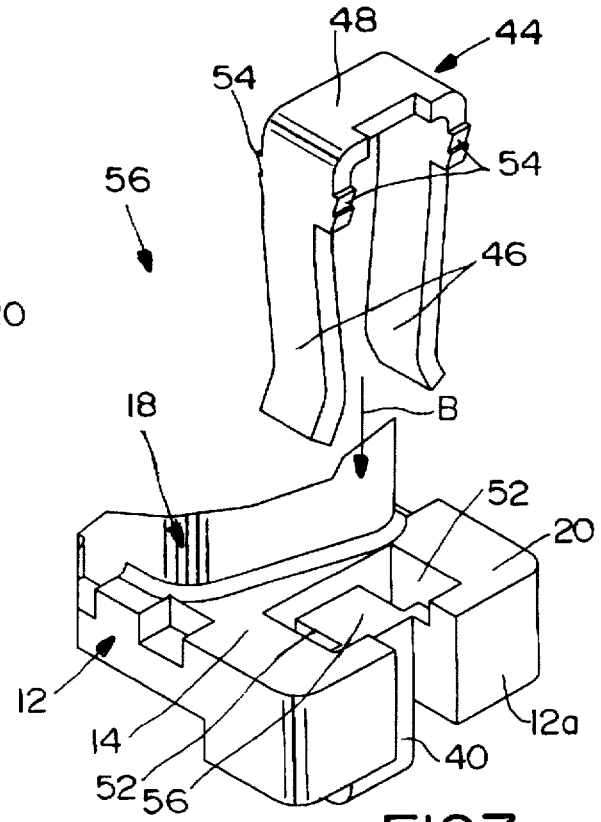
FIG. 7 is a perspective view of the right-hand end of the connector of FIG. 6, with the mounting clip removed from the connector.

More particularly, referring to FIGS. 7 and 8 in conjunction with FIG. 6, a pair of passages 52 (FIG. 7) extend through housing 12 between mating side 14 and mounting side 16, entirely through each wing portion 20 at each opposite end **12*a* of the housing. The details of one of the mounting clips 44 is shown clearly in FIG. 7, with the mounting clip removed from the housing. In addition to legs 46 and bight portion 48 of the mounting clip, the mounting clip also is provided with teeth 54 in the side edges thereof near bight portion 48. These teeth dig into the plastic material of the housing within passages 52 to hold the mounting clip in the housing. Each mounting clip 44 is assembled to the housing in the direction of arrow "B" (FIG. 7) until the mounting clip is fully assembled as shown in FIG. 8. During assembly, legs 46 are inserted into and through passages 52 in the respective wing portion 20 of the housing. Teeth 54 of the mounting clip are forced into an interference fit with the plastic material within passages 52. When fully assembled, whereas bight portion 48 of the mounting clip is rigidly fixed to the housing, legs 46 are resilient in the direction of double-headed arrow "C" (FIG. 8) so that the legs grip opposite surfaces of printed circuit board 28 at mounting pads 42. When assembled, bight portion 48 of the mounting clip embraces a substantial portion 56 (FIG. 7) of the housing so that the housing cannot be pulled away from the mounting clips when the clips are fully secured, as by soldering, to mounting pads 42** on the printed circuit board.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A system for straddle mounting an electrical connector having an elongated housing with opposite ends to a printed circuit board, said system comprising:

a pair of generally U-shaped mounting clips each having a pair of legs joined by a bight portion, each of said legs having a contact surface, said mounting clips having teeth thereon for relatively fixing said mounting clips to said housing, one mounting clip being located at each of said opposite ends of said elongated housing, said bight portion of each mounting clip embracing a portion of said housing;

said printed circuit board having an edge and opposite surfaces, with circuit traces on said opposite surfaces of the board near the edge;

said contact surface of each leg being juxtaposed against said opposite surfaces of said printed circuit board for connection to appropriate mounting pads thereon, wherein said teeth extend substantially parallel to said contact surface of said leg; and said electrical connector being adapted for straddle mounting to the printed circuit board along the edge thereof, with terminals on the housing and including tail portions for connection to the circuit traces on the opposite surfaces of the printed circuit board.

2. The system of claim 1 wherein said housing has a mating side remote from the board and a mounting side adjacent the edge of the board, and including a pair of passages extending through the housing in a direction between the mating side and the mounting side for each mounting clip, with the legs of the respective mounting clip extending through the passages and the bight portion of the mounting clip engaging a portion of the housing between the passages.

3. The system of claim 1 wherein said printed circuit board includes a cutout in the edge thereof for locating the housing of the connector.

4. A system in accordance with claim 1 wherein said legs are of similar length.

5. The system of claim 1 wherein said mounting clips are located in wing portions of the housing projecting longitudinally outwardly of the housing beyond a central mating portion of the housing.

6. The system of claim 5, including a pair of latches on the housing located longitudinally outwardly of the mounting clips, the latches being adapted for latching the connector to an appropriate complementary mating connector.

7. A system for straddle mounting an electrical connector having an elongated housing with opposite ends to a printed circuit board, said system comprising:

a pair of generally U-shaped mounting clips each having a pair of legs joined by a bight portion, each of said legs having a contact surface, said mounting clips having teeth thereon for relatively fixing said mounting clips to said housing, one mounting clip being located at each opposite end of said elongated housing, said bight portion of each mounting clip embracing a portion of the housing;

said printed circuit board having an edge and opposite surfaces, with circuit traces on said opposite surfaces of the board near the edge;

said electrical connector being adapted for straddle mounting to the printed circuit board along the edge thereof and having a mating side remote from the board and a mounting side adjacent the edge of the board, a central mating portion and wing portions at the opposite ends of the housing projecting longitudinally outwardly of the mating, portion, and a pair of passages extending through each wing portion of the housing in a direction between the mating side and the mounting side of the housing; and said legs of each mounting clip extending through said pair of passages in the respective wing portion and said contact surface of each leg being juxtaposed against said opposite surfaces of said printed circuit board for connection to appropriate mounting pads thereon, wherein said teeth extend substantially parallel to said contact surface of said leg.

8. The system of claim 7, including a pair of latches on the housing located longitudinally outwardly of the mounting clips, the latches being adapted for latching the connector to an appropriate complementary mating connector.

9. The system of claim 7 wherein said printed circuit board includes a cutout in the edge thereof for locating the housing of the connector.

10. A system in accordance with claim 7 wherein said legs are of similar length.

11. A system for straddle mounting an electrical connector having an elongated housing with opposite ends to a printed circuit board, said system comprising:

a generally U-shaped mounting clip having a pair of legs joined by a bight portion, each of said legs having a contact surface, said mounting clips having teeth thereon for relatively fixing said mounting clips to said housing, and the bight portion embracing a portion of the housing;

said printed circuit board having an edge and opposite surfaces, with circuit traces on said opposite surfaces of the board near the edge;

said contact surface of each leg being juxtaposed against said opposite surfaces of said printed circuit board for connection to appropriate mounting pads thereon, wherein said teeth extend substantially parallel to said contact surface of said leg; and said electrical connector being adapted for straddle mounting to the printed circuit board at the edge thereof, with terminals on the housing and including tail portions for connection to the circuit traces on the opposite surfaces of the printed circuit board.

12. The system of claim 11, including a latch on the housing located outwardly of the mounting clip, the latch being adapted for latching the connector to an appropriate complementary mating connector.

13. The system of claim 11 wherein said housing has a mating side remote from the board and a mounting side adjacent the edge of the board, and including a pair of passages extending through the housing in a direction between the mating side and the mounting side, the legs of the mounting clip extending through the passages and the bight portion of the mounting clip engaging a portion of the housing between the passages.

14. The system of claim 11 wherein said printed circuit board includes a cutout in the edge thereof for locating the housing of the connector.

15. A system in accordance with claim 11 wherein said legs are of similar length.

* * * * *